US008525746B2

(12) United States Patent
Petrucci et al.

(10) Patent No.: US 8,525,746 B2
(45) Date of Patent: Sep. 3, 2013

(54) IN-VEHICLE ANTENNA SYSTEM AND METHOD

(75) Inventors: David R. Petrucci, Sterling Heights, MI (US); Charles A. Massoll, Milford, MI (US); Donald B. Hibbard, Jr., Howell, MI (US); Nathan C. Callaghan, Fenton, MI (US)

(73) Assignee: GM Global Technology Operations, LLC, Detroit, MI (US)

( * ) Notice: Subject to any disclaimer, the term of this patent is extended or adjusted under 35 U.S.C. 154(b) by 420 days.

(21) Appl. No.: 12/794,308

(22) Filed: Jun. 4, 2010

(65) Prior Publication Data

US 2011/0298678 A1 Dec. 8, 2011

(51) Int. Cl.
*H01Q 1/32* (2006.01)

(52) U.S. Cl.
USPC ..... 343/711; 343/713

(58) Field of Classification Search
USPC ..... 343/711, 713, 872, 893
See application file for complete search history.

(56) References Cited

U.S. PATENT DOCUMENTS

| | | | | |
|---|---|---|---|---|
| 5,059,971 | A * | 10/1991 | Blaese | 343/713 |
| 5,099,252 | A | 3/1992 | Bryant et al. | |
| 6,921,859 | B2 * | 7/2005 | Hikita et al. | 174/381 |
| 7,064,721 | B2 * | 6/2006 | Zafar et al. | 343/725 |
| 7,629,943 | B2 * | 12/2009 | Tuttle | 343/872 |
| 7,850,078 | B2 * | 12/2010 | Christenson et al. | 235/382 |
| 2003/0048228 | A1 * | 3/2003 | Chen | 343/713 |

FOREIGN PATENT DOCUMENTS

| | | | |
|---|---|---|---|
| DE | 102006025176 | A1 | 12/2007 |
| DE | 102007019469 | A1 | 10/2008 |
| DE | 102007029952 | * | 1/2009 |
| DE | 102009015135 | A1 | 11/2010 |
| GB | 2298998 | A | 9/1996 |
| JP | 1036128 | A | 2/1989 |
| JP | 6140988 | A | 5/1994 |

* cited by examiner

*Primary Examiner* — Hoang V Nguyen

(57) ABSTRACT

An antenna system connectable to a vehicle includes an exterior antenna, an interior antenna, and a data transmission line. The vehicle has a wall including an outer surface and an inner surface that generally opposes the outer surface, where the inner surface and the outer surface cooperate together to create an aperture. The wall defines an exterior environment and an interior cabin. The exterior antenna is located within the exterior environment and is connectable to the vehicle. The interior antenna is located within the interior cabin defined. The data transmission line transmits RF signals and is in communication with both the exterior antenna and the interior antenna. The transmission line passes through the aperture located in the plate between the exterior antenna and the interior antenna.

20 Claims, 2 Drawing Sheets

IN-VEHICLE ANTENNA SYSTEM AND METHOD

FIELD

The present disclosure relates to a system and method of communicating radio frequency (RF) signals between antennas, and more particularly to a system and method of communicating RF signals between an exterior environment and an interior cabin.

BACKGROUND

The statements in this section merely provide background information related to the present disclosure and may or may not constitute prior art.

Certain vehicle regulations recently enacted require passenger vehicles to use solar management glass coatings. This type of glass coating causes less infrared energy to be transmitted into the interior cabin of the vehicle, which in turn reduces the heat load in the interior cabin of the vehicle. However, this coating does not generally allow for radio frequency (RF) signals to pass through the glass. As a result, if a portable electronic device is being used within the interior cabin of the vehicle, RF signals such as cellular telephone signals or global positioning system (GPS) signals will generally be unavailable. The portable electronic device is unable to receive the RF signals needed to perform some types of functions. For example, if a personal navigation device (PND) is placed within the interior cabin of the vehicle, a weak or non-existent GPS signal is available. As a result, the PND may not be able to provide positioning data. Moreover, if there is a weak or non-existent signal within the interior cabin, portable electronic devices will constantly search for an RF signal. Searching for RF signals will reduce the battery life of a portable electronic device, which can lead to customer dissatisfaction and complaints. Accordingly, there is a need in the art for a system that will allow RF signals to enter the interior cabin of a vehicle that utilizes solar management glass coatings.

SUMMARY

The present invention provides a method and system for communicating radio frequency (RF) signals between antennas. An antenna system connectable to a vehicle includes an exterior antenna, an interior antenna, and a data transmission line. The vehicle has a wall including an outer surface and an inner surface that generally opposes the outer surface, where the inner surface and the outer surface cooperate together to create an aperture. The wall defines an exterior environment and an interior cabin. The exterior antenna is located within the exterior environment and is connectable to the vehicle. The exterior antenna transmits and receives RF signals to and from an external RF device that is located in the exterior environment. The interior antenna is located within the interior cabin defined by the inner surface of the wall, where the interior antenna receives and transmits RF signals to and from an interior RF device located within the interior cabin. The data transmission line transmits RF signals. The data transmission line is in communication with both the exterior antenna and the interior antenna, where the transmission line passes through the aperture located in the plate between the exterior antenna and the interior antenna. The interior antenna communicates RF signals obtained from the interior RF device located within the interior cabin through the transmission line to the exterior antenna, and the exterior antenna communicates RF signals obtained from the external RF device through the transmission line to the interior antenna.

In an embodiment of the present invention, the interior antenna is located on a vehicle overhead console, a vehicle center console, an instrument panel, an A pillar, a B pillar, a C pillar, a D pillar, an integrated center stack faceplate, a front windshield, a rear windshield, a sunroof, or interior seats.

In another embodiment of the present invention, the exterior antenna is located on one of a roof of the vehicle, a cowl base, a side rearview mirror, a head lamp, a tail lamp, Center High Mounted Stop Lamps (CHMSL), a front windshield, a rear windshield, a sunroof, or a deck lid antenna.

In yet another embodiment of the present invention, the exterior antenna is a patch antenna having a ground plane.

In an embodiment of the present invention, the exterior antenna is attached to an exterior vehicle antenna, wherein the exterior vehicle antenna is used to transmit RF signals to a vehicle transceiver.

In another embodiment of the present invention, the interior antenna is a patch antenna.

In yet another embodiment of the present invention, the interior antenna provides a generally hemispherical RF pattern within the interior cabin.

In an embodiment of the present invention, the interior antenna is sized to receive and transmit either global positioning signals (GPS), satellite digital audio radio service (SDARS), or cellular signals.

In another embodiment of the present invention, at least one of the exterior antenna and the interior antenna are passive antennas.

In an embodiment of the present invention, the data transmission line is a coaxial cable.

A method of sending and receiving radio frequency (RF) signals from a vehicle is also disclosed. The vehicle has a wall including an outer surface and an inner surface that generally opposes the outer surface. The inner surface and the outer surface cooperate together to create an aperture. The method comprises the step of transmitting a first RF signal from an external RF device to an exterior antenna. The exterior antenna is disposed on the outer surface of the wall. The method further comprises the step of communicating the first RF signal from the exterior antenna to an interior antenna located within an interior cabin through a data transmission line. The wall defines an exterior environment and the interior cabin, where the data transmission line is in communication with both the exterior antenna and the interior antenna and passes through the aperture in the wall. The method further comprises the step of radiating the first RF signal from the interior antenna to the interior cabin such that an interior RF device receives the first RF signal. The method further comprises the step of transmitting a second RF signal from the interior RF device to the interior antenna. Finally, the method comprises the step of communicating the second RF signal from the interior antenna to the exterior antenna through the transmission line.

In an embodiment of the present invention, the method further comprises the step of transmitting the second RF signal from the exterior antenna to the external RF device.

In another embodiment of the present invention, the method further comprises the step of locating the interior antenna on either a vehicle overhead console, a vehicle center console, an instrument panel, an A pillar, a B pillar, a C pillar, a D pillar, an integrated center stack faceplate, a front windshield, a rear windshield, a sunroof, or interior seats.

In yet another embodiment of the present invention, the method further comprises the step of locating the exterior antenna on either a roof of the vehicle, a cowl base, a side rearview mirror, a head lamp, a tail lamp, a Center High Mounted Stop Lamps (CHMSL), a front windshield, a rear windshield, a sunroof, or a deck lid antenna.

In an embodiment of the present invention, the method further comprises the step of establishing the exterior antenna as a patch antenna having a ground plane.

In another embodiment of the present invention, the method further comprises the step of attaching the exterior antenna to an exterior vehicle antenna, wherein the exterior vehicle antenna is used to transmit RF signals to a vehicle transceiver.

In yet another embodiment of the present invention, the method further comprises the step of establishing the interior antenna as a patch antenna.

In an embodiment of the present invention, the method further comprises the step of providing a generally hemispherical RF pattern within the interior cabin by the interior antenna.

In another embodiment of the present invention, the method further comprises the step of sizing the interior antenna to receive and transmit either global positioning signals (GPS), satellite digital audio radio service (SDARS), or cellular signals.

In yet another embodiment of the present invention, the method further comprises the step of establishing at least one of the exterior antenna and the interior antenna as passive antennas.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
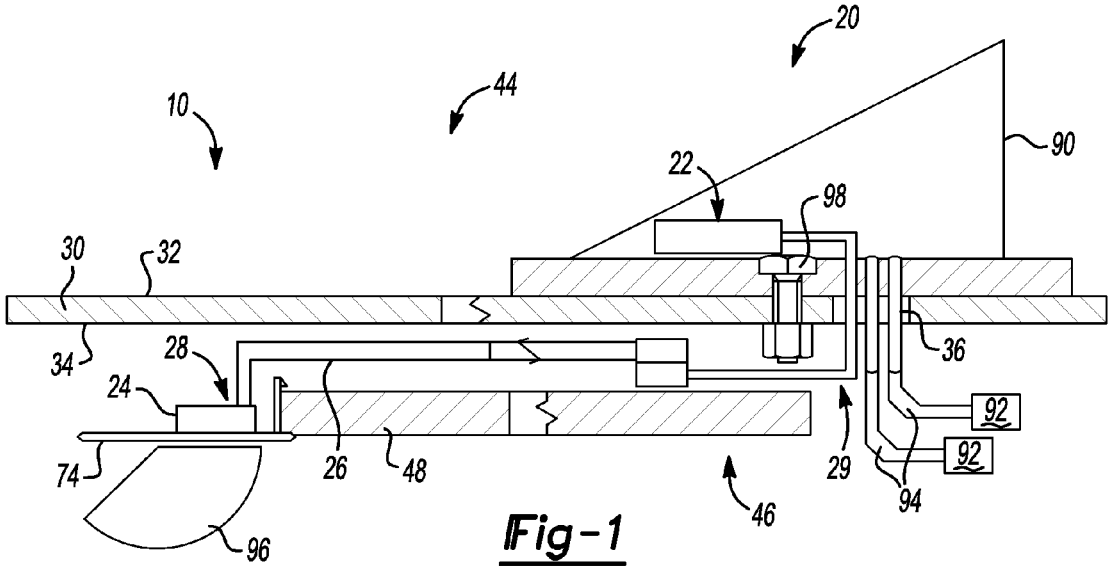
FIG. 1 is a schematic illustration of an exemplary antenna assembly including two antennas on a vehicle.

With reference to FIG. 1, a schematic view of a vehicle is generally indicated by reference number 10, where an antenna system 20 for receiving radio frequency (RF) signals is connected to the vehicle 10. The antenna system 20 includes an exterior antenna 22 and an interior antenna 24 that each transmit and receive RF signals as well as a data transmission line 26 used to communicate RF signals between the exterior antenna 22 and the interior antenna 24. The vehicle 10 includes a wall 30 having an outer surface 32 and an inner surface 34 generally opposing the outer surface 32. The outer surface 32 and the inner surface 34 cooperate together to create an aperture 36 located within the wall 30. The wall 30 is constructed from a material that does not generally allow for RF signals to pass through. In one embodiment, the wall 30 is the roof of the vehicle 10 and is constructed from a metallic material such as, for example, a steel alloy. Alternatively, the wall 30 can be a glass pane, such as the rear glass of the vehicle 10. The glass pane is coated with a solar management glass coating that does not generally allow for RF signals to pass through.

The wall 30 defines an exterior environment 44 and an interior cabin 46 of the vehicle 10. The exterior environment 44 includes the environment that is located outside of the vehicle 10, while the interior cabin 46 includes the environment within the vehicle 10. The exterior environment 44 is typically any type of outdoor environment. The interior cabin 46 includes an area between a headliner 48 and the wall 30 as well as the interior of the vehicle 10. The exterior antenna 22 is located in the exterior environment 44 and the interior antenna element 24 is located within the interior cabin 46. Although FIGS. 1-3B illustrate the antenna system 20 employed in a vehicle, those skilled in the art will appreciate that the antenna system 20 can be used in any application where RF signals are transmitted or received.

The aperture 36 is located and sized within the wall 30 such that the transmission line 26 can pass through the aperture 36. The aperture 36 allows for the transmission line 26 to be located within both the exterior environment 44 and the interior cabin 46. In the embodiment as shown, a first end 28 of the transmission line 26 is in electrical communication with the interior antenna 24 and a second end 29 of the transmission line 26 is in electrical communication with the exterior antenna 22, thereby connecting the exterior antenna 24 located in the exterior environment 44 with the interior antenna 24 located in the interior cabin 46. The transmission line 26 is any type of transmission line that carries RF signals such as, for example, a coaxial cable. In one embodiment, each of the ends 28 and 29 of the transmission line 26 are connected to the exterior and interior antennas 22 and 24 by a coaxial feed (not shown).

Figure 2:
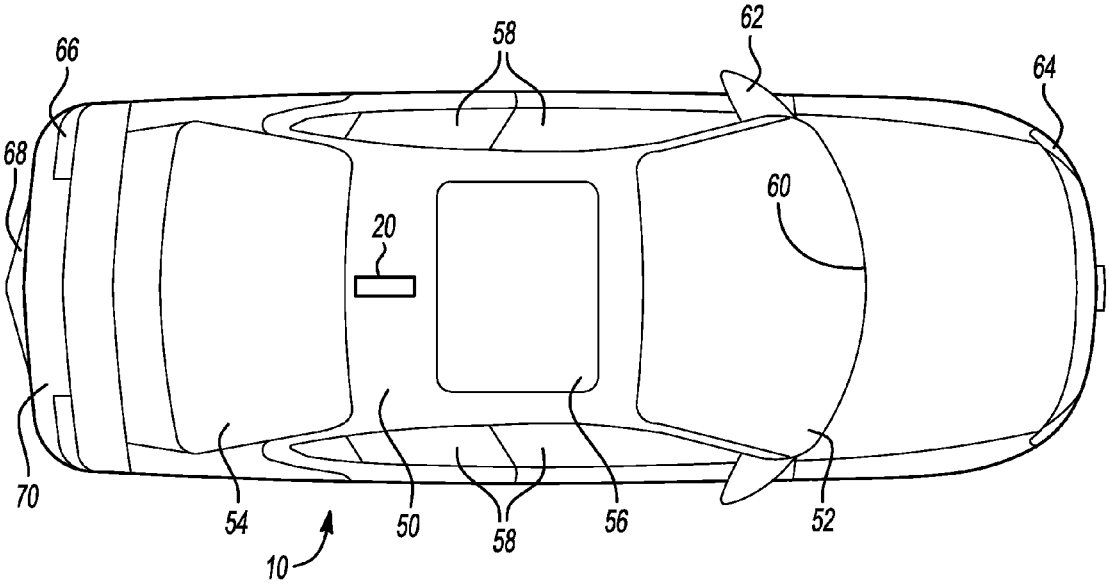
FIG. 2 illustrates an exterior view of the vehicle shown in FIG. 1.
Figure 3A:
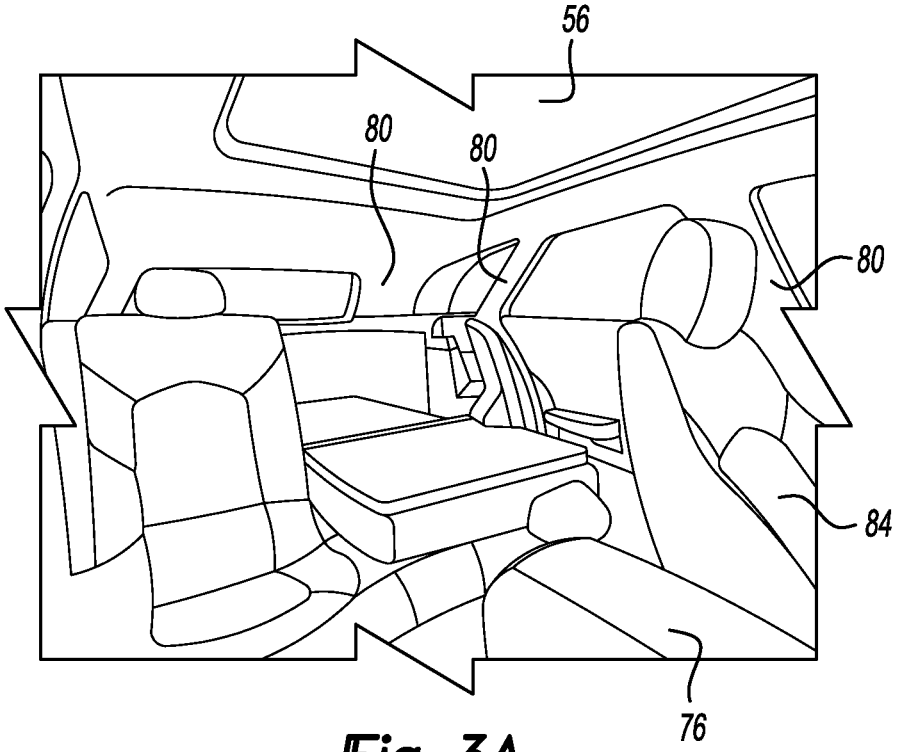
FIG. 3A is illustrates a portion of an interior of the vehicle shown in FIG. 1.
Figure 3B:
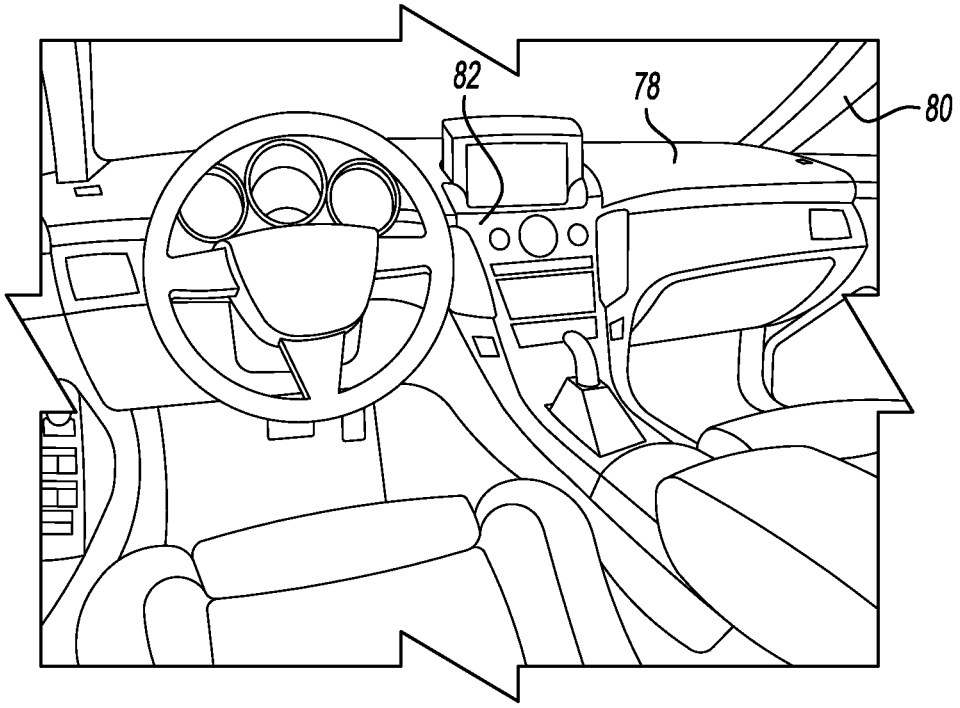
FIG. 3B illustrates a portion of the interior of the vehicle shown in FIG. 1.

The interior cabin 46 of the vehicle 10 typically has poor or non-existent RF signal reception. This is because the vehicle 10 has a roof constructed of a metallic material and the vehicle glass is typically coated with a solar management glass coating. Both the roof and the coated vehicle glass do not generally allow for RF signals to pass through. Turning to FIG. 2, an illustration of the exterior of the vehicle 10 is shown. The vehicle 10 has a roof 50 constructed of a metallic material such as, for example, a steel alloy. The vehicle 10 also includes a front windshield 52, a rear windshield 54, a sunroof 56, and side windows 58 that are coated with a solar management glass coating that substantially interferes with the transmission of RF signals. As a result, the antenna system 20 is employed to communicate RF signals between the interior cabin 46 and the exterior environment 44 (FIG. 1).

The exterior antenna 22 can be located along any exterior surface of the vehicle 10 that is capable of mounting the exterior antenna 22 thereon. In the illustration as shown, the exterior antenna 22 is mounted on the roof 50 of the vehicle 10. However, in another embodiment, the exterior antenna 22 could be mounted to a cowl base 60, a side rearview mirror 62, a head lamp 64, a tail lamp 66, Center High Mounted Stop Lamps (CHMSL) 68, the front windshield 52, the rear windshield 54, the sunroof 56, or a deck lid 70. Turning back to FIG. 1, the interior antenna 24 can be positioned in any location within the interior cabin 46 that allows for the interior antenna 24 to receive and transmit RF signals located within the interior cabin 46. FIG. 1 illustrates the interior antenna 24 positioned within an overhead console 74 of the vehicle 10, however, it is understood that the interior antenna 24 can be positioned in other locations as well. For example, turning to FIGS. 3A-3B, the interior antenna 24 could be positioned in a vehicle center console 76, an instrument panel 78, an A, B, C or D pillar 80, an integrated center stack faceplate 82, the front windshield 52 (FIG. 2), the rear windshield 54 (FIG. 2), the sunroof 56, or the interior seats 84. Thus, while the embodiment in FIG. 1 illustrates the exterior antenna 22 as a roof mounted antenna and the interior antenna 24 located in the overhead console 74, other packaging options for the exterior and interior antennas 22 and 24 exist as well. This means that the antenna system 20 can be packaged such that the exterior antenna 22 can be positioned at various locations along the exterior surface of the vehicle 10. At the same time, the interior antenna 24 can be positioned in various locations within the interior cabin 46 as well. As a result, the exterior and interior antennas 22 and 24 can be positioned in various locations either in or on the vehicle in an effort to accommodate the unique packaging restraints of a specific vehicle. The locations of the exterior and interior antennas 22 and 24 can also be positioned to accommodate the cable attenuation of the transmission line 26. Specifically, the packaging locations of the interior and exterior antenna 22 and 24 may depend on the available length of the transmission line 26, as a longer data transmission line 26 results in greater signal attenuation.

In the embodiment as shown, the antenna system 20 has a passive design. This means that the exterior and interior antennas 22 and 24 each do not include an amplifier. However, those skilled in the art will appreciate that the antenna system 20 can also include an active design as well, which means the exterior and interior antennas 22 and 24 are amplified. Specifically, the antennas 22, 24 could have an active design using a two-way amplifier. However, it may be more cost effective to employ a passive design instead in some embodiments, as a passive design does not need an amplifier, therefore reducing cost as well as complexity of the antenna system 20. Moreover, a passive design does not require vehicle electrical load and would not typically impact electric consumption or power requirements of the vehicle 10.

In the embodiment as shown in FIG. 1, the exterior antenna 22 is a patch type antenna having a ground plane. Although FIG. 1 illustrates the exterior antenna 22 as a patch type antenna those skilled in the art will appreciate that other types of antennas may be used as well. For example, in another embodiment the exterior antenna 22 could be a mirror type antenna. The exterior antenna 22 can also be attached to or integrated with a vehicle antenna 90. The vehicle antenna 90 can be any type of externally mounted antenna used to transmit RF signals to the vehicle's 10 transceiver 92. FIG. 1 illustrates the vehicle antenna 90 as a fin type antenna, however it is understood that other types of antennas may also be employed. Various other types of antennas (not illustrated) used to transmit and receive different types of RF signals can be located within the vehicle antenna 90. For example, the vehicle antenna 90 could include a satellite digital audio radio service (SDARS) antenna or a cellular antenna in addition to the exterior antenna 90. The other antennas located within the vehicle antenna 90 are connected to the respective vehicle transceiver 92 through a data line 94. The data line 94 is any type of transmission line for carrying radio frequency signals such as, for example, a coaxial cable. FIG. 1 illustrates two separate vehicle transceivers 92, namely a cellular transceiver as well as a SDARS transceiver.

FIG. 1 illustrates the interior antenna 24 as a patch type antenna, however those skilled in the art will appreciate that other types of antennas may be used as well. The patch type antenna can be sized for a particular frequency. For example, if it is desired to pass (SDARS) signals, the patch type antenna can be sized to transmit and receive SDARS signals. Alternatively, in another example the patch type antenna could also be sized to transmit and receive cellular telephone signals. In one example, the interior antenna 24 can be several different patch antennas that are integrated to receive several different types of signals, such as, for example, a patch antenna that receives both SDARS as well as GPS signals.

The transmission line 26 communicates RF signals between the exterior antenna 22 and the interior antenna 24. Specifically, the interior antenna 24 communicates RF signals obtained from the interior cabin 46 through the transmission line 26 to the exterior antenna 22. The exterior antenna 22 communicates RF signals obtained from the external environment 44 through the transmission line 26 to the interior antenna 24. If a portable electronic RF device (not shown) is located within the interior cabin 46 of the vehicle 10, the electronic RF device is generally unable to send or receive RF signals from an external RF device that is located in the exterior environment 44. This is because RF signal reception is typically poor or non-existent within the interior cabin 46 of the vehicle, as the roof 50, the front windshield 52, the rear windshield 54, and the sunroof 56 (FIG. 2) are constructed from materials that do not generally allow for RF signals to pass through. The portable electronic RF device can be any type of portable electronic device that is capable of transmitting RF signals, receiving RF signals, or both. For example, the electronic RF device could be a cellular telephone, a laptop computer with a wireless Internet connection, an AM/FM radio, or a personal navigation device (PND). The external RF device is any type of structure located in the environment outside of the interior cabin 46 of the vehicle 10 that is capable transmitting RF signals, receiving RF signals or both. For example, the external RF device could be a GPS satellite, a cellular telephone tower, an AM radio tower, or an FM radio tower.

In one example, if a portable electronic RF device such as a PND is located within the interior cabin 46 of the vehicle, the RF signals can not generally travel through the wall 30 and communicate with an external RF device such as a GPS satellite. Instead, the antenna system 20 transmits the RF signals from the interior cabin 46 to the satellite located outside of the vehicle 10. First, the portable electronic RF device communicates an RF signal to the interior antenna 24. The RF signal is communicated from the interior antenna 24, through the transmission line 26, and to the exterior antenna 22. The exterior antenna 22 communicates the RF signal to a satellite, where the RF signal contains information such as, for example, the position of the vehicle 10 in relation to Earth. The satellite then communicates an RF signal to the exterior antenna 22 containing information such as, for example, directions from the vehicle's present position to another predetermined destination. The RF signal is communicated from the exterior antenna 22, through the transmission line 25, and to the interior antenna 24. The interior antenna 24 then radiates the RF signal into the interior cabin 46, and provides an RF signal to the portable electronic RF device. In the embodiment as illustrated, the interior antenna 24 provides a generally hemispherical pattern 96 within the interior cabin 46, however it is understood that the interior antenna 24 can radiate different types of antenna patterns as well.

FIG. 1 illustrates a fastening device 98 that is used to position the exterior antenna 22 on the outer surface 32 of the wall 30 and the interior antenna 24 within the interior cabin 46. The fastening device 98 can be any type of fastener that is used to secure the exterior antennas 22 to the wall 30 such as, for example, a bolt. The antenna assembly 20 can be installed on the vehicle 10 during production. Alternatively, the antenna assembly 20 is a retrofit, where the aperture 36 could be added to the vehicle 10 and the exterior and interior antennas 22 and 24 as well as the transmission line 26 could be installed after production.

With continued reference to FIGS. 1-3B, a method for communicating an RF signal with the antenna system 20 is discussed. The method begins at a first step where the antenna system 20 including the exterior antenna 22 and the interior antenna 24 is established. The outer surface 32 and the inner surface 34 of the wall 30 cooperate together to create the aperture 36. The aperture 36 is located within and sized in the wall 30 such that the transmission line 26 can pass through the aperture 36, thereby connecting the exterior antenna 22 located in the exterior environment 44 with the interior antenna 24 located in the interior cabin 46. In one embodiment, the antenna system 20 is connected to a vehicle 10, however it is understood that the antenna system 20 may be employed in other applications as well. The method then proceeds to a second step.

In the second step, a first RF signal is transmitted from an external RF device to the exterior antenna 22. The first RF signal can be any type of radio frequency signal such as, for example, a cellular telephone signal. The external RF structure is any type of structure that is capable of transmitting RF signals, receiving RF signals, or both. For example, the external RF structure could be a GPS satellite, a cellular telephone tower, and an FM or AM radio tower. The method may then proceed to a third step.

In the third step, the first RF signal is communicated from the exterior antenna 22 to the interior antenna 24 through the transmission line 26. The transmission line 26 communicates RF signals between the exterior antenna 22 and the interior antenna 24. Specifically, the exterior antenna 22 communicates RF signals obtained from the external environment 44 through the transmission line 26, and to the interior antenna 24. The method may then proceed to a fourth step.

In the fourth step, the first RF signal is radiated from the interior antenna 24 and into the interior cabin 46 such that the electronic RF device receives the first RF signal. For example, FIG. 1 illustrates the interior antenna 24 provides a generally hemispherical pattern 96 within the interior cabin 46. However, it is understood that the interior antenna 24 can radiate different types of antenna patterns as well. The method may then proceed to a fifth step.

In the fifth step, a second RF signal from the electronic RF device is transmitted to the interior antenna 24. The electronic RF device any type of portable electronic device that is capable of transmitting RF signals, receiving RF signals, or both. In the fifth step, the electronic RF device transmits the second RF signal into the interior cabin 46 of the vehicle 10, and the interior antenna 24 receives the second RF signal. The method may then proceed to a sixth step.

In the sixth step, the second RF signal is communicated from the interior antenna 24 to the exterior antenna 22 through the transmission line 26. Similar to the third step, the interior antenna 24 communicates RF signals obtained from the interior cabin 46 through the transmission line 26 to the exterior antenna 22. The method may then proceed to a seventh step.

In the seventh step, the second RF signal is transmitted from the exterior antenna 22 to the external RF device. For example, if the RF signal is a GPS signal, then the second RF signal is communicated to a GPS satellite. The second RF signal can include information, such as for example, the position of the vehicle 10 in relation to the Earth. In one embodiment, the method may then proceed back to the second step. For example, the GPS satellite could then communicate a RF signal to the exterior antenna 22 containing information such as, for example, directions from the vehicle's present position to another predetermined destination. Alternatively, the method may then terminate.

The description of the invention is merely exemplary in nature and variations that do not depart from the gist of the invention are intended to be within the scope of the invention. Such variations are not to be regarded as a departure from the spirit and scope of the invention.

What is claimed is:

1. An antenna and motor vehicle system, the antenna and motor vehicle system comprising, in combination:

the motor vehicle having a cabin wall including an outer surface, and an inner surface that generally opposes the outer surface and a plurality of glass windows having a solar management coating, wherein the inner surface and the outer surface cooperate to create an aperture, and wherein the cabin wall defines an exterior environment and an interior cabin;

an exterior antenna located within the exterior environment and connected to the vehicle, wherein the exterior antenna transmits and receives RF signals to and from an external RF device that is located in the exterior environment; and an interior antenna located within the interior cabin defined by the inner surface of the wall, wherein the interior antenna receives and transmits RF signals to and from an interior RF device located within the interior cabin, and a data transmission line that transmits RF signals, wherein the data transmission line is in direct electrical communication with both the exterior antenna and the interior antenna, and wherein the transmission line passes through the aperture located in the inner surface and the outer surface of the cabin wall, and wherein the interior antenna communicates RF signals obtained from the interior RF device located within the interior cabin through the transmission line to the exterior antenna, and the exterior antenna communicates RF signals obtained from the external RF device through the transmission line to the interior antenna.

2. The antenna system of claim 1 wherein the interior antenna is located on one of a vehicle overhead console, a vehicle center console, an instrument panel, an A pillar, a B pillar, a C pillar, a D pillar, an integrated center stack faceplate, a front windshield, a rear windshield, a sunroof, and interior seats.

3. The antenna system of claim 1 wherein the exterior antenna is located on one of a roof of the vehicle, a cowl base, a side rearview mirror, a head lamp, a tail lamp, Center High Mounted Stop Lamps (CHMSL), a front windshield, a rear windshield, a sunroof, and a deck lid antenna.

4. The antenna system of claim 1 wherein the exterior antenna is a patch antenna having a ground plane.

5. The antenna system of claim 4 wherein the exterior antenna is attached to an exterior vehicle antenna, wherein the exterior vehicle antenna is used to transmit RF signals to a vehicle transceiver.

6. The antenna system of claim 1 wherein the interior antenna is a patch antenna.

7. The antenna system of claim 1 wherein the interior antenna provides a generally hemispherical RF pattern within the interior cabin.

8. The antenna system of claim 1 wherein the interior antenna is sized to receive and transmit one of global positioning signals (GPS), satellite digital audio radio service (SDARS), and cellular signals.

9. The antenna system of claim 1 wherein at least one of the exterior antenna and the interior antenna are passive antennas.

10. The antenna system of claim 1 wherein the data transmission line is a coaxial cable having a first end connected to the exterior antenna and a second end connected to the interior antenna.

11. A method of sending and receiving radio frequency (RF) signals from a motor vehicle, wherein the motor vehicle has a wall defining an interior cabin and including an outer surface and an inner surface that generally opposes the outer surface, wherein the inner surface and the outer surface cooperate to create an aperture, the method comprising:

substantially preventing RF signals from entering the interior cabin by disposing windows in the wall having a solar management coating, transmitting a first RF signal from an external RF device to an exterior antenna, wherein the exterior antenna is disposed on the outer surface of the wall;

communicating the first RF signal from the exterior antenna to an interior antenna located within the interior cabin through a data transmission line, where the wall defines an exterior environment and the interior cabin, and wherein the data transmission line directly electrically connects the exterior antenna and the interior antenna and passes through the aperture in the wall;

radiating the first RF signal from the interior antenna to the interior cabin such that an interior RF device receives the first RF signal;

transmitting a second RF signal from the interior RF device to the interior antenna; and communicating the second RF signal from the interior antenna to the exterior antenna through the transmission line.

12. The method of claim 11 wherein the method further comprises transmitting the second RF signal from the exterior antenna to the external RF device.

13. The method of claim 11 wherein the method further comprises locating the interior antenna on one of a vehicle overhead console, a vehicle center console, an instrument panel, an A pillar, a B pillar, a C pillar, a D pillar, an integrated center stack faceplate, a front windshield, a rear windshield, a sunroof, and interior seats.

14. The method of claim 11 wherein the method further comprises locating the exterior antenna on one of a roof of the vehicle, a cowl base, a side rearview mirror, a head lamp, a tail lamp, Center High Mounted Stop Lamps (CHMSL), a front windshield, a rear windshield, a sunroof, and a deck lid antenna.

15. The method of claim 11 wherein the method further comprises establishing the exterior antenna as a patch antenna having a ground plane.

16. The method of claim 15 wherein the method further comprises attaching the exterior antenna to an exterior vehicle antenna, wherein the exterior vehicle antenna is used to transmit RF signals to a vehicle transceiver.

17. The method of claim 11 wherein the method further comprises establishing the interior antenna as a patch antenna.

18. The method of claim 11 wherein the method further comprises providing a generally hemispherical RF pattern within the interior cabin by the interior antenna.

19. The method of claim 11 wherein the method further comprises establishing at least one of the exterior antenna and the interior antenna as passive antennas.

20. A motor vehicle and passive antenna system, the motor vehicle having an interior cabin having side windows coated with a solar management glass coating that substantially interferes with transmission of RF signals, the motor vehicle and passive antenna system comprising, in combination:

a wall including an outer surface and an inner surface that generally opposes the outer surface, wherein the inner surface and the outer surface cooperate to create an aperture, and wherein the wall and the windows define an exterior environment and the interior cabin;

an exterior antenna located in the exterior environment and connected to the vehicle, wherein the exterior antenna transmits and receives RF signals to and from an external RF device that is located in the exterior environment;

an interior antenna located within the interior cabin defined by the inner surface of the wall, wherein the interior antenna receives and transmits RF signals to and from an interior RF device located within the interior cabin; and a coaxial cable that carries RF signals, wherein the coaxial cable directly electrically connects the exterior antenna and the interior antenna, and wherein the coaxial cable passes through the aperture located in the plate between the exterior antenna and the interior antenna, and wherein the interior antenna communicates RF signals obtained from the interior RF device located within the interior cabin through the coaxial cable to the exterior antenna, and the exterior antenna communicates RF signals obtained from the external RF device through the coaxial cable to the interior antenna.

* * * * *